United States Patent [19]

Ferguson

[11] 4,037,269

[45] July 19, 1977

[54] APPARATUS FOR CHARGING FIELD ELECTRICAL CABLES

[75] Inventor: Paul M. Ferguson, Tulsa, Okla.

[73] Assignee: Tesco Engineering Company, Tulsa, Okla.

[21] Appl. No.: 667,407

[22] Filed: Mar. 16, 1976

[51] Int. Cl.[2] ..... H05C 1/04

[52] U.S. Cl. ..... 361/232

[58] Field of Search ..... 317/262 S; 361/232

[56] References Cited

U.S. PATENT DOCUMENTS

| | | | |
|---|---|---|---|
| 3,878,444 | 4/1975 | Miller | 317/262 S |
| 3,986,085 | 10/1976 | Weber | 317/262 S |

*Primary Examiner*—R. N. Envall, Jr.

*Attorney, Agent, or Firm*—Daniel Silverman

[57] ABSTRACT

A cable charger for generating a timed series of pulses of high d.c. voltage, comprising a battery, inverter, and rectifier means to produce a high voltage d.c., means responsive to a first timing means to connect said battery to said inverter at periodic intervals and means responsive to a second timing means to disconnect said inverter from said battery at a selected time interval after the connection of said inverter to said battery. An alternate embodiment includes means responsive to the voltage output of the rectifier means for disconnecting the inverter from the battery when the voltage output reaches a selected value E. The connecting means between the battery and the inverter can be relay means or solid state switching means.

16 Claims, 2 Drawing Figures

TIME
VB
VO
A
B
C
D
T0
T1
T2
T3

APPARATUS FOR CHARGING FIELD ELECTRICAL CABLES

REFERENCE TO RELATED PATENT

This application is related to U.S. Pat. No. 3,878,444, in the name of Sheldon Miller, issued Apr. 15, 1975, entitled: Method and Apparatus for Protecting Electrical Field Cables Against Rodent Damage.

BACKGROUND OF THE INVENTION

This invention lies in the field of electrical charging devices, such as fence chargers, which produce a series of timed short-time-duration pulses, of high voltage, to be applied to wire fences, for the control of animals.

More particularly this invention lies in the field of voltage chargers for the protection of electrical insulated cables from damage by animals.

Still more particularly this invention described a type of voltage charger that can be applied to the protection of electrical cables from damage by animals.

In the prior art, it has been customary to control large field animals by setting up an insulated wire fence surrounding an enclosure, and applying to the insulated wires an electrical, pulsating voltage, of high enough voltage, to electrically shock the animal whenever it contacts the wire. The shock is not enough to injure the animal, but it is enough to discourage it from approaching the wire.

Commercial "fence charger" devices have been on the market for many years for charging such fences.

In the seismic geophysical field of exploration for minerals in the earth, long, multiconductor cables have been deployed along the ground for the purpose of connecting geophones to amplifiers, etc. Since these cables are often 5–10 miles in length, it is impossible to police the area to drive animals away that might bite into the cables, and cause breaks in the conductors.

In some undeveloped areas of the country, severe damage to the cables is experienced, particularly from small animals, such as rodents.

The referenced U.S. Pat. No. 3,878,444 described an improved type of cable construction, which in conjunction with a suitable source of pulsating voltage connected to a shield under the jacket, has been found to effectively deter animals from biting or otherwise harming the cables.

The big problem has been the provision of a suitable voltage source. When the conventional fence charger was used to charge the cable, it was found that the conventional fence charger is a generator with high internal impedance, whereas the cable shield has a high capacitance to round, and therefore has a low impedance to ground. Consequently, when the fence charger is used to charge the cable, the voltage output drops to a small fraction of the voltage it delivers when charging a fence wire, because the fence wire has a high impedance to ground.

In view of the impedance mismatch of the fence charger to the cable, it was determined that what was needed was a charger that had a low internal impedance, which could deliver a high voltage into the low impedance of the cable.

To do this requires a large power source, and such a power source is not readily available. The best type of power source that can be left unattended 24 hours a day is an electrical battery. Even so, the handling of heavy batteries and the problem of keeping them charged, is such a difficult procedure in the field, that the power drain must be kept to a minimum.

In seismic operations, variable lengths of cable are often required, and since the impedance to ground of the actual cable depends on its length, the load impedance on the cable charger may vary from day to day.

Therefore means must be provided for setting a time schedule of voltage pulses that will be frequent enough to ensure that the animal will feel the shock no matter how short the contact time. Also means must be provided to ensure that the pulse voltage reaches a selected value of voltage E. And further, means must be provided to terminate the pulse as shown as the selected voltage E is reached, in order to minimize the power drain from the battery or other power source.

It is therefore a primary object of this invention to provide a source of high voltage which repetitively generates a high d.c. voltage pulse.

It is a further object to ensure that the output voltage reaches the selected value of voltage E irrespective of the load impedance of the cable to which it is attached.

It is still a further object of this invention to provide means for terminating the pulse as soon as possible after it reaches the selected value of voltage E.

SUMMARY OF THE INVENTION

These and other objects and advantages of this invention are realized, and the limitations of the prior art are overcome, by providing a source of electrical power, such as a battery, and a power conversion means, such as an inverter, high voltage transformer and rectifier, for generating a d.c. potential of selected magnitude.

Power connecting means, such as relay means, or solid state switching means, are provided for connecting the power conversion means to the power supply, and timing means for repetitively enabling the connecting means, to apply power to the power conversion means.

On enabling the power connecting means, the power source is connected to the power conversion means, or the battery is connected to the inverter, and a voltage starts to build up on the output of the high voltage rectifier. This voltage does not build up instantly, but in accordance with the load impedance of the cable connected to the rectifier, it builds up exponentially, at a rate which is faster for high impedance loads, and slower for low impedance loads. When the voltage builds up to a selected value E, means are provided for disabling the power connecting means so as to cut off power to the inverter, and thus save power until the next enabling time.

The disabling can be controlled by a timing circuit which is manually adjusted for each cable connected, to ensure that the output voltage E is actually reached. Also switching means can be provided responsive to the output voltage itself, such that when the voltage reaches E, the power is cut off from the inverter, etc. This provides an automatic disabling, dependent only on the voltage, which is dependent on the load.

BRIEF DESCRIPTION OF THE DRAWINGS

These and other objects of this invention and a better understanding of the principles and details of the invention will be evident from the following description taken in conjunction with the appended drawings, in which.

DESCRIPTION OF THE PREFERRED EMBODIMENT

Figures 1, 2:
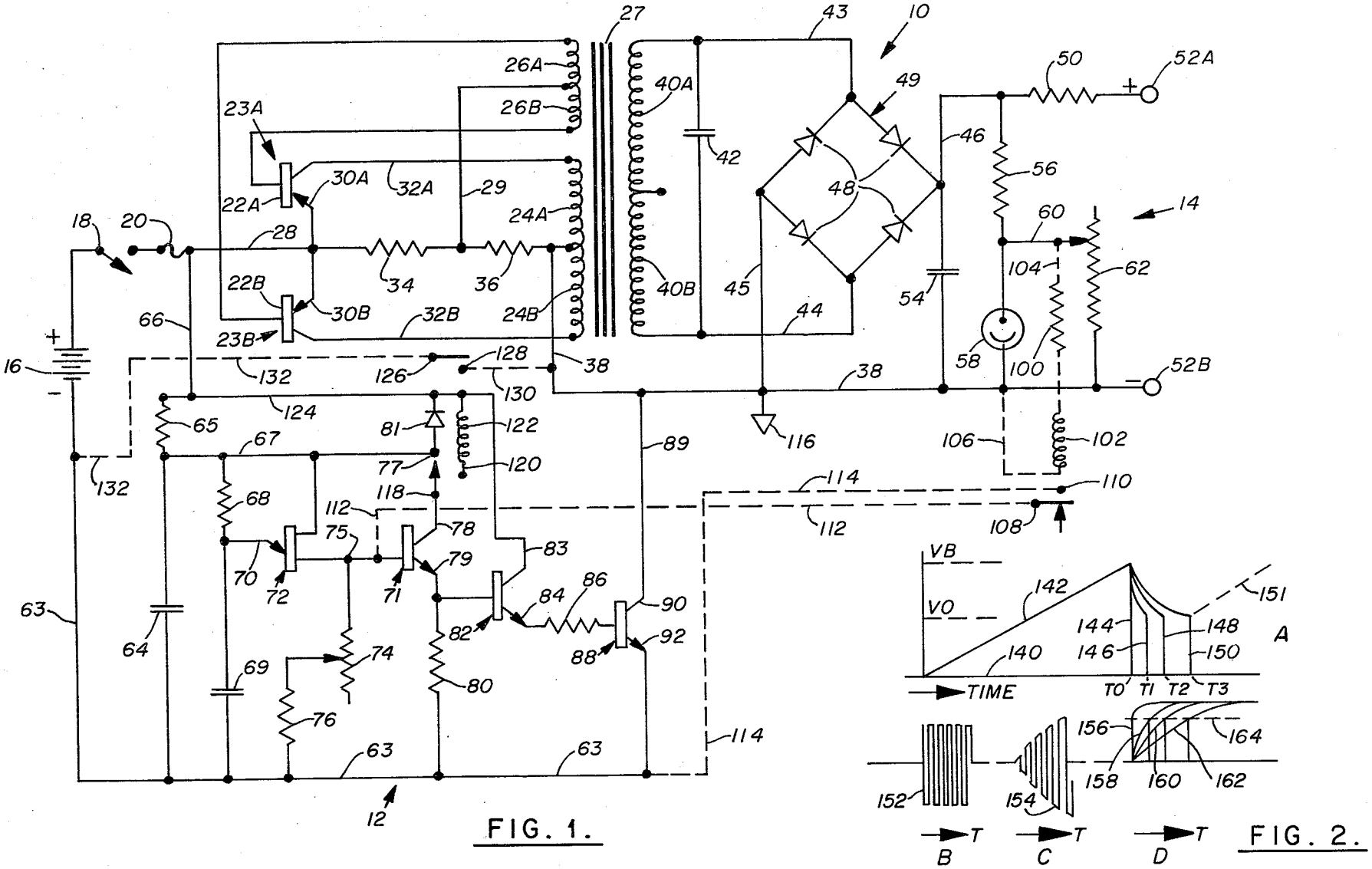
FIG. 1 illustrates in schematic form one embodiment in solid line, and alternate embodiments in dashed line.
FIG. 2 illustrates details of operation of the apparatus of FIG. 1.

Referring now to the drawing, and in particular to FIG. 1, numeral 10 indicates generally the power converting means, numeral 12 indicates generally the power connecting means, numeral 14, the power utilization means, and numeral 16 represents the power supply, or battery.

The positive end of the battery 18 goes to switch 18, fuse 20 and via lead 28 to the emitters 22A, 22B of two transistors 23A, 23B. The lead 28 goes through resistors 34, 36 to the midtap connecting primary coils 24A, 24B of transformer 27.

Two secondary coils 26A, 26B are joined by lead 29 to the junction of resistors 34, 36. The other ends of coils 26A, 26B are connected to the bases 22A, 22B of transistors 23A, 23B.

Two high voltage secondary coils 40A, 40B are connected in series across a bridge 49 of rectifier diodes 48, through leads 43, 44, with a capacitor 42 in parallel. The output of the bridge 49 of rectifier 48 goes by lead 46, through limiting resistor 50 to the high voltage connection 52A, and through lead 45 to lead 38 and case ground 116. The ouput is filtered by capacitor 54. Series resistor 56 and variable resistor 62 are connected across capacitor 54. Neon lamp 58 is connected across resistor 62.

When a load, such as the conductor of the seismic cable is connected to the high voltage terminal 52A, and a ground stake is connected to the other terminal 52B, a capacitive load is connected across the output, which varies, depending on the type and length of the cable. By the use of an oscilloscope, or other voltmeter, connected across the terminals 52A, 52B, the resistor 62 is increased until the neon lamp 58 turns on when the voltmeter reads the selected voltage E.

Since the breakdown voltage of the neon lamp is substantially constant, the potentiometer 56, 62 can be calibrated with the neon lamp 58 as a velometer, indicating by the lighting of 58, that the voltage 52A to 52B is equal to or greater than E.

The positive battery lead 66 goes to dropping resistor 65 and filter capacitor 64 to provide a filtered supply voltage on lead 67. This goes to a timing circuit of resistor 68 and capacitor 69, with the junction 70 between them going to the emitter of the unijunction diode 72, which connects the base of transistor 71 to the plus voltage line 67. Junction point 75 is connected through variable resistor 74, and resistor 76 to lead 63 which goes to the negative terminal of the battery 16. With switch 118 connected to 77, the collector 78 of transistor 71 is connected to power lead 67, while the emitter 79 is connected through resistor 80 to 63, the battery negative.

The base of transistor 82 is connected to emitter 79, while collector 83 goes to power lead 124, and emitter 84 goes through limiting resistor 86 to the base of power transistor 88, the collector 90 of which goes through lead 89 to lead 38, while the emitter 92 goes to battery return 63.

The operation of the control, or power connecting means 12 is as follows: When switch 18 is closed, voltage builds up on capacitor 64 to supply filtered voltage on 67. Capacitor 69 charges up through resistor 68, and when the voltage on 70 reaches the operating voltage of the unijunction diode 72, it closes the circuit from 67 to 75. This raises the potential of the base of 71, causing the transistor 71 to conduct from 67, 77, 78, 79 through 80 to battery 63. This raises the potential of the base of transistor 82 and it conducts, raising the potential of the base of power transistor 88. This connects lead 38 to the battery negative, 63, applying power to the inverter and building up voltage across the diode bridge 49 and capacitor 54.

Referring now to FIG. 2A there is shown a curve of the potential of junction 70. As the voltage across capacitor 69 builds up the voltage 142 rises to a value $V_B$, at which the unijunction diode 72 closes, applying voltage from 75 through resistors 74, 76 to battery 63. The capacitor 69 now begins to discharge through 72 and through resistors 74, 76, and the voltage at 70 begins to fall along one of the curves 144, 146, 148, 150 etc. These curves are shown for different values of resistance of 74. The highest value of 74 corresponds to the curve 150, having the longest time duration $T_3$. When the voltage 70 drops to a value $V_O$, which is a characteristic of the unijunction diode 72, the circuit opens and the capacitor 69 begins to recharge along curve 151, while the voltage at 75 which followed that of 70, now drops to zero, stopping the conduction of transistors 71, 82, 88, opening the circuit between 38 and 63 and removing power from the inverter. When the voltage at 70 rises again to $V_B$, the process is repeated.

It was shown, how, by adjusting the value of resistor 74, the time interval between $T_O$, when the inverter is turned on, and times $T_1$, $T_2$, $T_3$, at which the inverter is turned off, can be varied. The purpose of this adjustment is to keep the inverter on until the output voltage reaches the selected voltage E.

The rate at which the output voltage at 52A builds up, depends on the load impedance. That is, it depends on the capacitance of the cable (type of cable and length of cable).

FIG. 2B illustrates the build up of 152 of the a.c. voltage of the inverter, for no load (high impedance load) condition. FIG. 2C shows the same 154 for a high load (low impedance load) condition.

At low load, the voltage builds up rapidly, and the d.c. voltage would build up the curve 156 of FIG. 2D. When the load is high, the a.c. builds up like FIG. 2C, and the d.c., like curve 160 or 162, etc.

The value of voltage 164 is the selected value of E, which has been set as the value to which the voltage will rise on each charging cycle. Since this value of voltage is reached at different times $T_1$, $T_2$, $T_3$, etc., depending on the load, the control of resistor 74 is made available to the operator.

In practice, the cable conductor is connected to 52A, and 52B is connected to a ground stake. The switch 18 is closed and the charger started. The resistor 74 is started at a low value, setting a short time such as $T_1$. If the neon lamp 58 flashes each cycle, this indicates that under the existing load the output reaches the voltage E, as indicated by the calibrated setting of the lamp 58.

If the lamp 58 does not flash, the resistance 74 is increased, lengthening the time interval that the inverter is on, until the lamp does flash each cycle.

In this way the operation ensures that the voltage E is produced each cycle, and also that a minimum quantity of energy is consumed each cycle.

In FIG. 1 a switch 118 is shown connected to the collector 78 of transistor 71. When this is switched to contact 120, it connects through relay coil 122 to lead 124, to the battery plus terminal. The relay contacts 126, 128 are connected (as an alternative connection) to dashed lead 132 to battery negative and lead 130 to lead 38. Thus the relay 122 and contacts 126, 128 serve as power connecting means to apply power to the inverter. The use of the relay 122 is a substitute for the power transistors 82 and 88, and either type of control can be used. The unijunction diode 72 and transistor 71 are used for both switching means, in association with the basic timing circuit 68, 69 and the adjustable resistor 74 for "time-on" control.

Also shown in FIG. 1 is a relay coil 102 connected through resistor 100 across the neon lamp 58, between leads 60 and 38. Here the relay 100 acts as a voltmeter, and when the output voltage reaches E, the relay 100 pulls in contacts 108, 110, and through dashed leads 114, 112 connects junction 75 to lead 63, discharging capacitor 69 and turning off transistor 71 and the inverter.

By the use of the relay 102, there is no need for the control resistor 74 and a fixed high resistance is used, and the actual time interval that the inverter draws power is determined by the time it takes the output voltage to reach E.

The use of the relay 102 demonstrates the automatic feature of this method of conserving power. Since a fast acting circuit closing means is desired, a solid state switching means such as a unijunction diode or transistor, etc. can be used to connect between 75 and 63, since a man skilled in the art would know how to do this, there is no need for further detail.

The detail design of the circuit of FIG. 1 would be well known to a man skilled in the art. However, in a system that has operated satisfactorily, the following values of the circuit components have been used.

23A, 23B = 2N5436
34 and 36 = 3.3 and 47 ohms
27 = Triad TY85
48 = EGG 125
65 = 330 ohms
64 = 100μF
69 = 4.7μF
68 = 270K ohms
72 = 2N4870
76 and 74 = 47 and 500 ohms
71 = SM 3904
82 = SK 3041
88 = SK 3036
80 and 86 = 1000 and 3.3 ohms The value of E that is selected, is a matter which is based on operating conditions. In general, it will be a voltage of the order of several hundred volts up to perhaps 600 volts or more. No limitation in this voltage is implied by the foregoing description, since the apparatus can be designed for any selected value E.

The power source was described as a battery, for purpose of illustration and convenience. Any other source can be used such as an engine driven generator, or similar source.

While the invention has been described with a certain degree of particularity, it is manifest that many changes may be made in the details of construction and the arrangement of components. It is understood that the invention is not to be limited to the specific embodiment set forth herein by way of exemplifying the invention, but the invention is to be limited only by the scope of the attached claim or claims, including the full range of equivalency to which each element or step thereof is entitled.

What is claimed:

1. In a cable having at least one conductor under a jacket, said conductor having low and variable capacitive impedance to ground, and means for applying a series of time-spaced high potential pulses to said conductor, for the purpose of discouraging animals from biting into said cable, comprising:

a cable charger for generating said high potential pulses to be applied to said at least one conductor, comprising;

a. a source of electrical power;
b. power conversion means responsive to said source of power for generating said series of time-spaced high potential pulses of selected magnitude;
c. power connecting means connected between said power source and said power conversion means;
d. timing means to enable said power connecting means at first selected time intervals to apply said power source to said energy conversion means;
e. said high potential pulses of a form that increase in magnitude of potential with time;
f. means to determine the instantaneous magnitude of said high potential pulses; and
g. responsive to said instantaneous magnitude of said high potential pulses, means to disable said power connecting means to remove said power source from said power conversion means.

2. The cable charger as in claim 1 in which said power connecting means comprises relay means.

3. The cable charger as in claim 1 in which said power connecting means comprises solid state switching means.

4. The cable charger as in claim 1 in which said means to disable includes means to disconnect said power source from said power conversion means at second selected time intervals after said power source has been connected to said power conversion means.

5. The cable charger as in claim 1 in which said means to disable is responsive to the time that said instantaneous magnitude of said high potential reaches a selected value.

6. The cable charger as in claim 4 including means to vary said second selected time interval responsive to the instantaneous magnitude of said high potential pulses.

7. The cable charger as in claim 1 in which said at least one conductor under a jacket includes a plurality of conductors under said jacket.

8. The cable charger as in claim 1 in which said at least one conductor under a jacket comprises a conductive wrapping under said jacket.

9. The cable charger as in claim 1 in which said cable comprises a multiconductor cable having a first jacket, a conductive wrapping over said first jacket, and a second jacket over said conductive wrapping, said conductive wrapping connected to said charger output.

10. A cable charger for generating a recurring series of high voltage pulses for application to a conductor under a jacket of an electrical cable, for the purpose of discouraging animals from biting into said cable, said conductor having a low variable capacitive impedance to ground, said charger comprising;

a. a source of electrical power;
b. high voltage generating means responsive to said electrical power source, for generating a high d.c. voltage, and responsive to said low capacitive impedance of said conductor, said high d.c. voltage is of a form in which its instantaneous magnitude increases with time.

c. power connecting means to connect said power source to said high voltage generating means;

d. enabling means to repetitively enable said power connecting means;

e. means to determine the instantaneous magnitude of said high d.c. voltage; and f. disabling means to disable said power connecting means responsive to said instantaneous magnitude of said high d.c. voltage.

11. The cable charger as in claim 10 in which said enabling means includes first timing means.

12. The cable charger as in claim 10 in which said disabling means includes second timing means, said second timing means responsive to said instantaneous magnitude of said high d.c. voltage.

13. The cable charger as in claim 10 in which said disabling means is directly responsive to the instantaneous magnitude of the high d.c. voltage output of said voltage generating means.

14. The cable charger as in claim 10 in which said power source is a battery, and said high voltage generating means includes inverter and rectifier means.

15. The cable charger as in claim 10 in which the rate of rise of magnitude of said high d.c. voltage output of said high voltage generating means is a function of the electrical capacitive impedance to ground of said conductor in said cable.

16. The cable charger as in claim 12 in which said second timing means is variable and is adapted to be set to disable said power connecting means at a time interval such as to permit said magnitude of said high d.c. voltage to reach a selected value E.

* * * * *